US006917914B2

(12) United States Patent
Chamberlain

(10) Patent No.: US 6,917,914 B2
(45) Date of Patent: Jul. 12, 2005

(54) VOICE OVER BANDWIDTH CONSTRAINED LINES WITH MIXED EXCITATION LINEAR PREDICTION TRANSCODING

(75) Inventor: Mark W. Chamberlain, Honeoye Falls, NY (US)

(73) Assignee: Harris Corporation, Melbourne, FL (US)

( * ) Notice: Subject to any disclaimer, the term of this patent is extended or adjusted under 35 U.S.C. 154(b) by 89 days.

(21) Appl. No.: 10/355,164

(22) Filed: Jan. 31, 2003

(65) Prior Publication Data

US 2004/0153317 A1 Aug. 5, 2004

(51) Int. Cl.[7] ..... G10L 19/04
(52) U.S. Cl. ..... 704/219; 704/230; 704/229
(58) Field of Search ..... 704/219, 208, 704/230, 207, 229

(56) References Cited

U.S. PATENT DOCUMENTS 5,806,027 A * 9/1998 George et al. ..... 704/230
6,122,608 A * 9/2000 McCree ..... 704/219
6,463,407 B2 * 10/2002 Das et al. ..... 704/208
2003/0065506 A1 * 4/2003 Adut ..... 704/207

FOREIGN PATENT DOCUMENTS

JP 06-222796 * 1/1993 ..... G10L/9/14

OTHER PUBLICATIONS

McCree et al ("A Mixed Excitation LPC Vocoder Model For Low Bit Rate Speech Coding", IEEE Transactions on Speech and Audio Processing, Jul. 1995).*
Yeldener et al ("A Mixed Sinusoidally Excited Linear Prediction Coder At 4 Kb/S And Below", IEEE International Conference on Acoustics, Speech, & Signal Processing, May 1998).*

* cited by examiner

*Primary Examiner*—Vijay B. Chawan
(74) *Attorney, Agent, or Firm*—Duane Morris LLP

(57) ABSTRACT

Vector quantization techniques reduce the effective bit rate to 600 bps while maintaining intelligible speech. Four frames of speech are combined into one frame. The system uses mixed excitation linear prediction speech model parameters to quantized the frame and achieve a fixed rate of 600 bps. The system allows voice communication over bandwidth constrained channels.

18 Claims, 4 Drawing Sheets

VOICE OVER BANDWIDTH CONSTRAINED LINES WITH MIXED EXCITATION LINEAR PREDICTION TRANSCODING

BACKGROUND

The Mixed Excitation Linear Prediction model (MELP) was developed by the U.S. government's DOD Digital Voice Processing Consortium (DDVPC)(Supplee, Lynn M., Cohn, Ronald P., Collura, John S., McCree, Alan V., "MELP:The New Federal Standard at 2400 bps", IEEE ICASSP-97 Conference, Munich Germany, the context of which is herein incorporated by reference) as the next standard for narrow band secure voice coding. The new speech model represents a dramatic improvement in speech quality and intelligibility at the 2.4 Kbps data rate. The algorithm performs well in harsh acoustic noise such as HMMWV's, helicopters and tanks. The buzzy sounding speech of the existing LPC10e speech model has been reduced to an acceptable level. The MELP model represents the next generation of speech processing in bandwidth constrained channels.

The MELP model as defined in MIL-STD-3005 is based on the traditional LPC10e parametric model, but also includes five additional features. These are mixed-excitation, aperiodic pulses, pulse dispersion, adaptive spectral enhancement, and Fourier magnitudes scaling of the voiced excitation.

The mixed-excitation is implemented using a five band-mixing model. The model can simulate frequency dependent voicing strengths using a fixed filter bank. The primary effect of this multi-band mixed excitation is to reduce the buzz usually associated with LPC10e vocoders. Speech is often a composite of both voiced and unvoiced signals. MELP performs a better approximation of the composite signal than LPC10e's Boolean voiced/unvoiced decision.

The MELP vocoder can synthesize voiced speech using either periodic or aperiodic pulses. Aperiodic pulses are most often used during transition regions between voiced and unvoiced segments of the speech signal. This feature allows the synthesizer to reproduce erratic glottal pulses without introducing tonal noise.

Pulse dispersion is implemented using a fixed pulse dispersion filter based on a spectrally flattened triangle pulse. The filter is implemented as a fixed finite impulse response (FIR) filter. The filter has the effect of spreading the excitation energy within a pitch period. The pulse dispersion filter aims to produce a better match between original and synthetic speech in regions without a formant by having the signal decay more slowly between pitch pulses. The filter reduces the harsh quality of the synthetic speech.

The adaptive spectral enhancement filter is based on the poles of the Linear Predictive Coding (LPC) vocal tract filter and is used to enhance the formant structure in synthetic speech. The filter improves the match between synthetic and natural band pass waveforms, and introduces a more natural quality to the output speech.

The first ten Fourier magnitudes are obtained by locating the peaks in the Fast Fourier Transform (FFT) of the LPC residual signal. The information embodied in these coefficients improves the accuracy of the speech production model at the perceptually important lower frequencies. The magnitudes are used to scale the voiced excitation to restore some of the energy lost in the $10^{th}$ order LPC process. This increases the perceived quality of the coded speech, particularly for males and in the presence of background noise.

MELP parameters are transmitted via vector quantization. Vector quantization is the process of grouping source outputs together and encoding them as a single block. The block of source values can be viewed as a vector, hence the name vector quantization. The input source vector is then compared to a set of reference vectors called a codebook. The vector that minimizes some suitable distortion measure is selected as the quantized vector. The rate reduction occurs as the result of sending the codebook index instead of the quantized reference vector over the channel.

The vector quantization of speech parameters has been a widely studied topic in current research. At low rate transmission of quantized data, efficient quantization of the parameters using as few bits as possible is essential. Using suitable codebook structure, both the memory and computational complexity can be reduced. One attractive codebook structure is the use of a multi-stage codebook as described in "Vector Quantization and Signal Compression" (Gersho A., Gray R. M., Vector Quantization and Signal compression, Norwell, MA:Kluwer Academeic Publishers, 1991, the content of which is hereby incorporated by reference). The codebooks presented in this paper are designed using the generalized Lloyd algorithm to minimize average weighted mean-squared error using the TIMIT speech database as training vectors.

The generalized Lloyd algorithm consists of iteratively partitioning the training set into decisions regions for a given set of centroids. New centroids are the n re-optimized to minimize the distortion over a particular decision region. The generalized Lloyd algorithm is reproduced below from Y. Linde, A. Buzo, and R. M. Gray. "An algorithm for vector quantizer design." IEEE Trans. Comm., COM-28:84–95, January 198, the content of which is hereby incorporated by reference.

Lloyd Algorithm

1. Start with an initial set of codebook values $\{Y_i^{(0)}\}_{i=1,M}$ and a set of training vectors $\{X_n\}$. Set k=0, $D^{(0)}=0$. Select a threshold $\epsilon$.

2. The quantization region $\{V^{(k)}\}_{i=1,m}\}$ are given by $$Vi(k)-\{X_n:d(X_n,Y_j)<d(X_n,Y_j)\forall j\neq i\}i=1,2,\ldots,M.$$

3. Compute the average distortion $D^{(k)}$ between the training vectors and the representative codebook value.

4. If $(D^{(k)}-D^{(k-1)})/D^{(k)}<\epsilon$, stop; otherwise, continue.

5. k=k+1. Find new codebook values $\{Y_i^{(k)}\}_{i=1,M}$ that are the average value of the elements of each quantization regions $V_i^{(k-1)}$. Go to step 2.

Vector quantization of MELP parameters allows for intelligible speech to be transmitted at lower data rates such as 2400 bps then otherwise possible, however, these low rates are often not low enough when transmitted over bandwidth constrained channels,(i.e. narrow bandwidth channels such as 3 kHz bandwidth) to enable reception and reconstruction of intelligible speech.

Embodiments of the disclosed subject matter overcome these and other problems in the art by presenting a novel system and method for improving the speech intelligibility and quality of a vocoder operation at a bit rate of 600 bps. The disclosed subject matter presents a coding process using the parametric mixed excitation linear prediction model of the vocal tract. The resulting 600 bps vocoder achieves very high Diagnostic Rhyme Test scores(DRT, A measure of speech intelligibility) and Diagnostic Acceptability measure scores (DAM, A measure of speech quality), these tests described in Voiers, William D., "Diagnostic Acceptability measure (DAM): A Method for Measuring the Acceptability of Speech over Communication System", Dynastat, Inc. :Austin Tex. and Voiers, William D., "Diagnostic Evaluation of Speech Intelligibility.", in M. E. Hawley, Ed, Speech Intelligibility and Speech Recognition (Dowder, Huchinson, and Ross: Stroudsburg, Pa. 1977) both of which are herein incorporated by reference. The scores on these tests are higher than vocoders at similar bit rates published in recent literature. The resulting 600 bps vocoder can be used in a secure communication system allowing communication on High Frequency (HF) radio channels under very poor signal to noise ratios and or under low transmit power conditions. The resulting MELP 600 bps vocoder results in a communication system that allows secure speech radio traffic to be transferred over more radio links more often throughout the day than the MELP 2400 bps based system.

The subject matter of the disclosure uses Vector Quantization techniques to reduce the effective bit-rate necessary to send intelligible speech over a bandwidth constrained channel. Harsh High Frequency (HF) channels which are limited to only 3 kHz causes modems to require low bit-rates to maintain intelligible speech. The disclosed subject matter vector quantizes the mixed excitation linear prediction speech model parameters to achieve a fixed bit rate of 600 bps while still providing relatively good speech intelligibility and quality.

It is an object of the disclosed subject matter to present in a voice communication system operating on a bandwidth constrained channel, novel methods of transmitting and receiving a voice signal. An embodied method including the steps of obtaining a plurality of sub blocks of speech representing the voice signal and generating unquantized MELP parameters for each of the sub blocks of speech. The embodied method further involves quantizing the plurality of sub blocks of speech as an output block using the unquantized MELP parameters of each of the blocks to create quantized MELP parameters of the output block. The quantized output block is encoded into a serial bit stream and transmitted over a bandwidth constrained channel. In a method embodying the disclosed subject matter, the serial bit stream is received and the quantized MELP parameters of the output block are extracted. The embodiment method also include decoding the quantized MELP parameters to form unquantized MELP parameters associated with output block of speech and creating from them unquantized MELP parameters for each of the sub blocks. The method reconstructs the voice signal sequentially for each sub block from their associated unquantized MELP parameters.

It is also an object of the disclosed subject matter to present in a voice communication system, a novel method of transcoding four MELP 2400 bps frames 25 ms in length into a MELP 600 bps frame 100 ms in length for voice communication over a bandwidth limited channel. Embodiments of the method include obtaining unquantized MELP parameters from each of the MELP 2400 bps frames and combining them to form one MELP 600 bps 100 ms frame. An embodiment of the method creates unquantized MELP parameters for the MELP 600 bps 100 ms frame from unquantized MELP parameters from the MELP 2400 bps frames and quantizes the MELP parameters of the MELP 600 bps 100 ms frame and encoding them into a 60 bit serial stream for transmission.

It is further an object of the disclosed subject matter to present in a voice communication system, a novel method of formatting quantized vectors for transmission and reception of 100 ms of speech. Embodiments of the method quantizing a first half spectrum from a set of unquantized MELP parameter associated with a first set of plural frames of speech; and encoding the first half spectrum in 19 bits of a 60 bit serial stream, quantizing a second half spectrum from another set of unquantized MELP parameters associated with a second set of plural blocks of speech; and encoding the second half spectrum in 19 bits of the 60 bit serial stream. Embodiments also quantizing a bandpass voicing parameter created from the unquantized MELP parameters of the first and second set of plural blocks of speech; and encoding the quantized bandpass voicing parameter in 4 bits the 60 bit serial stream; and quantizing a pitch voicing parameter created from the unquantized MELP parameters of the first and second set of plural blocks of speech; and encoding the quantized pitch parameters in 7 bits of the 60 bit serial stream. The embodied method also includes the step of quantizing a gain parameter created from the unquantized MELP parameters of the first and second set of plural blocks of speech, and encoding the quantized gain parameters in 11 bits of the 60 bit serial stream.

These and many other objects and advantages of the present invention will be readily apparent to one skilled in the art to which the invention pertains from a perusal or the claims, the appended drawings, and the following detailed description of the preferred embodiments.

BRIEF DESCRIPTION OF THE DRAWINGS

The disclosed subject matter will be described with reference to the following drawings.

DETAILED DESCRIPTION

Figure 1:
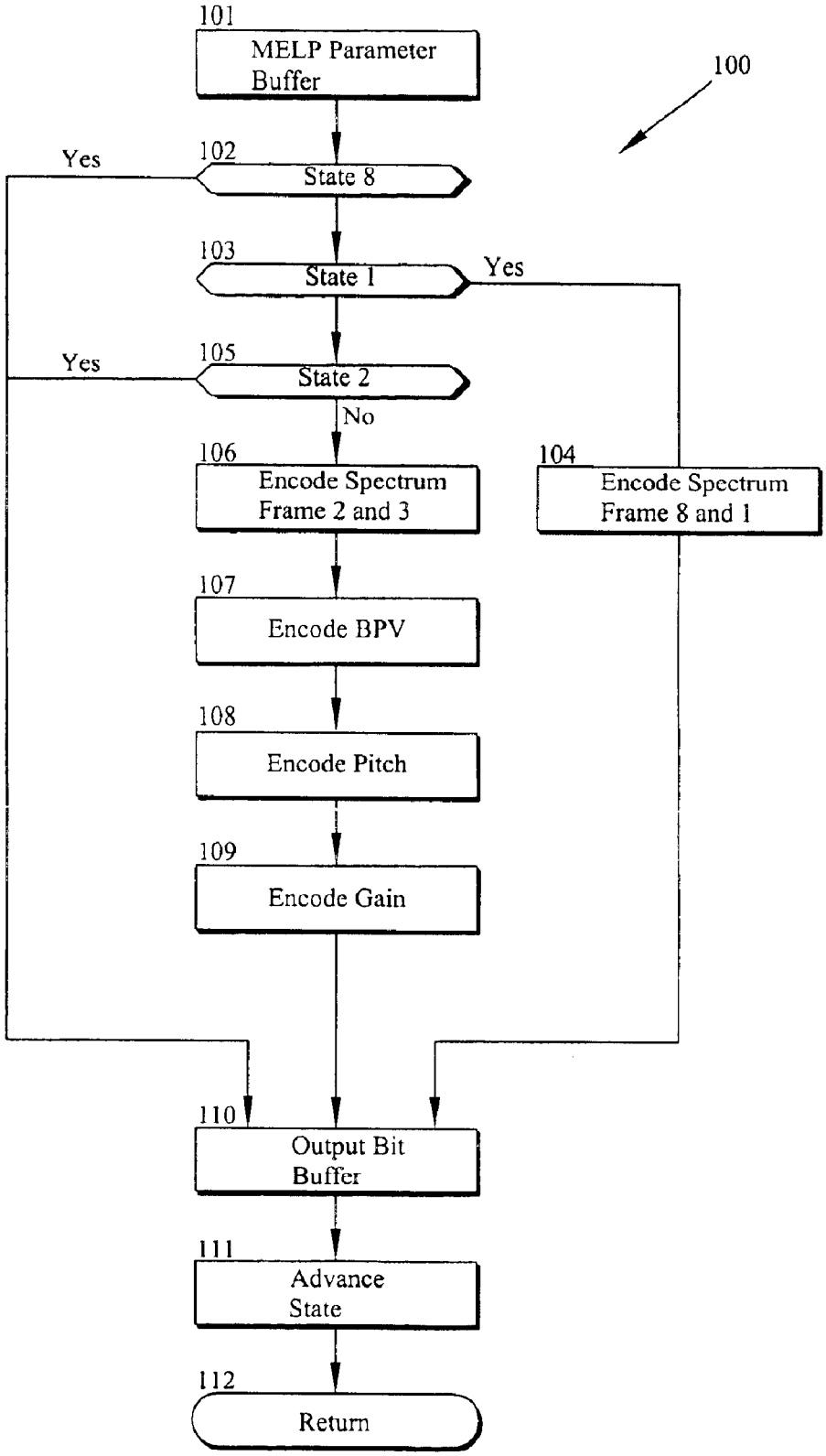
FIG. 1 illustrates a schematic block diagram of a MELP 600 encoding process according to the disclosed subject matter.

In order to reduce the data rate, the MELP 2400 bps parameters are transcoded to a MELP 600 bps format. The disclosed subject matter does not require nor should it be construed to be limited to the use of MELP 2400 bps processing to develop the MELP parameters. The embodiments may use other MELP processes or MELP analysis to generate the unquantized MELP parameters for each of the frames or blocks of speech. The frames' combined unquantized MELP parameters are then used to quantized all the blocks as a single block, frame, unit or entity by using bandpass voicing, energy, Fourier magnitudes, pitch, and spectrum parameters.

Aperiodic pulses are designed to remove the LPC synthesis artifacts of short, isolated tones in the reconstructed speech. This occurs mainly in areas of marginally voiced speech, when reconstructed speech is purely periodic. The aperiodic flag indicates a jittery voiced state is present in the frame of speech. When voicing is jittery, the pulse positions of the excitation are randomized during synthesis based on a uniform distribution around the purely periodic mean position.

Investigation of the run-length of the aperiodic state indicates that the run-length is normally less than three frames across the TIMIT speech database over several noise conditions. Further, if a run of aperiodic voiced frames does occur, it is unlikely that a second run will occur within the same block of four frames. Therefore the aperiodic bit of the MELP is ignored in the disclosed embodiments since the effects on voice quality are not as significant as the remaining MELP parameters.

Bandpass Voicing Quantization

The band-pass voicing (BPV) strengths control which of the five bands of excitation are voiced or unvoiced in the MELP model. The MELP standard sends the upper four bits individually while the least significant bit is encoded along with the pitch. These five bits are advantageously quantized down to only two bits with very little audible distortion. Further reduction can be obtained by taking advantage of the frame-to-frame redundancy of the voicing decisions. The current low-rate coder uses a four-bit codebook to quantize the most probable voicing transitions that occur over a four-frame block. A rate reduction from four frames of five bit band-pass voicing strengths is reduced to only four bits. At four bits, some audible differences are heard in the quantized speech. However, the distortion caused by the band-pass voicing is not offensive.

Energy Quantization

MELP's energy parameter exhibits considerable frame-to-frame redundancy, which can be exploited by various block quantization techniques. A sequence of energy values from successive frames can be grouped to form vectors of any dimension. In the MELP 600 bps model embodiment, a block length of four frames is used (two gain values per frame) resulting in a vector length of eight. The energy codebook in an embodiment was created using the K-means vector quantization algorithm. Other methods to create quantization codebooks can also be utilized. This codebook is trained using training data scaled by multiple levels to prevent sensitivity to speech input level. During the codebook training process, a new block of four energy values is created for every new frame so that energy transitions are represented in each of the four possible locations within the block.

For MELP 2400 bps, two individual gain values are transmitted every frame period. The first gain value is quantized to five bits using a 32-level uniform quantizer ranging from 10.0 to 77.0 dB. The second gain value is quantized to three bits using an adaptive algorithm that is described in [1]. In an embodiment of the MELP 600 bps model both of MELP's gain values are vector quantized across four frames. Using an 2048 element codebook, a reduction in the energy from 8 bits per frame for MELP 2400 bps down to 2.909 bits per frame for MELP 600 bps. Quantization values below 2.909 bits per frame for energy are possible, however the quantization distortion becomes audible in the synthesized output speech, deleteriously affecting intelligibility at the onset and offset of words.

Fourier Magnitudes Quantization

The excitation information is augmented by including Fourier coefficients of the LPC residual signal. These coefficients or magnitudes account for the spectral shape of the excitation not modeled by the LPC parameters. These Fourier magnitudes are estimated using a FFT on the LPC residual signal. The FFT is sampled at harmonics of the pitch frequency. In the current MIL-STD-3005, the lower ten harmonics are considered more important and are coded using an eight-bit vector quantizer over a 22.5 ms frame.

In the MELP 600 bps embodiment the Fourier magnitude vector is quantized to one of two vectors. For unvoiced frames, a spectrally flat vector is selected to represent the transmitted Fourier magnitude. In voiced frames, a single vector is used to represent all voiced frames. The voiced frame vector is selected to reduce the harshness in low-rate vocoders. The reduction in rate for the remaining MELP parameters reduce the effect occurring at the higher data rates to Fourier magnitudes. No additional bits are required to perform the above quantization.

Pitch Quantization

The MELP model estimates the pitch of a frame using energy normalized correlation of 1 kHz low-pass filtered speech. The MELP model further refines the pitch by interpolating fractional pitch values as described in "Analog-to-Digital Conversion of voice by 2400 bps Mixed Excitation Linear Prediction (MELP)", MIL-STD-3005, December 1999, the contents of which are hereby incorporated by reference. The refined fractional pitch values are then checked for pitch errors resulting from multiples of the actual pitch value. It is this final pitch value that the MELP 600 vocoder uses to vector quantize.

MELP's final pitch value is first median filtered (order 3) such that some of the transients are smoothed to allow the low rate representation of the pitch contour to sound more natural. Four successive frames of the smooth pitch values are vector quantized using a codebook with 128 elements. The codebook can be trained using the k-means method described earlier. The resulting codebook is searched resulting in the vector that minimizes mean squared error of voiced frames of pitch.

Spectrum Quantization

The LPC spectrum of MELP is converted to line spectral frequencies (LSFs) as described in Soong F., Juan B., "Line Spectrum Pairs (LSP) and Speech Compression", IEEE Int. Conf. On Acoustics, Speech, and Signal Processing, 1983., the contents of which are hereby incorporated by reference. The use of LSFs is one of the more popular compact representations of the LPC spectrum. The LSF's are quantized with a four-stage vector quantization algorithm described in Juang B. H., Gray A. H. Jr., "Multiple Stage vector Quantization for Speech Coding", In International Conference on Acoustics, Speech, and Signal Processing, volume 1, pages 597–600, Paris France, April 1982., the content of which is hereby incorporated by reference. The first stage has seven bits, while the remaining three stages use six bits each. The resulting quantized vector is the sum of the vectors from each of the four stages and the average vector. At each stage in the search process, the VQ search locates the "M best" closest matches to the original using a perceptual weighted Euclidean distance. These M best vectors are used in the search for the next stage. The indices of the final best at each of the four stages determine the final quantized LSF.

The low-rate quantization of the spectrum quantizes four frames of LSFs in sequence using a two individual two-stage vector quantization process. The first stage of codebook use ten bits, while the remaining stage uses nine bits. The search for the best vector uses a similar "M best" technique with perceptual weighting as is used for the MIL-STD-3005 vocoder. Two frames of spectra are quantized to only 19 bits (four frames then require 38 bits).

The codebook generation process uses both the K-Means and the generalized Lloyd technique. The K-Means codebook is used as the input to the generalized Lloyd process. A sliding window was used on a selective set of training speech to allow spectral transitions across the two-frame block to be properly represented in the final codebook. It is important to note that the process of training the codebook requires significant diligence in selecting the correct balance of input speech content. The selection of training data was created by repeatedly generating codebooks and logging vectors with above average distortion. This process removes low probability transitions and some stationary frames that can be represented with transition frames without increasing the over-all distortion to unacceptable levels.

A MELP 600 bps encoder embodiment's block diagram 100 is shown in FIG. 1. The disclosed subject matter first runs a MELP 2400 bps analysis frame on a 25 ms block of speech, as discussed above, other MELP analysis can all also be used. The Analysis frame process will then generate a number of unquantized MELP parameters as described above which are then stored in a four frame buffer 101 by an algorithm. In block 102, the unquantized MELP parameters of the initial frame or zero state is passed to the output buffer 110. The frame or state is then advanced in block 111 and the process is return in block 112 to the MELP parameter Buffer 101, for MELP 2400 bps analysis on the next 25 ms block of speech. In Block 103 the unquantized MELP parameters of the second or state one is passed to block 104 to quantized the spectrum of frame 0 and 1. The encoded spectrum contains 19 bits and is stored in the output buffer 110 as bits 0–18 and the process continues to block 111 as described previously. In block 105, the unquantized MELP parameters of the third frame or state 2 likewise is passed to the output buffer 110. Upon receipt of the last or state 3 frame, all the unquantized MELP parameters for each frame or block of speech are available, therefore the output stream representing all four blocks or states can be encoded.

The spectrum for frame 2 and 3 is quantized in block 106. This second spectrum quantization contains 19 bits as discussed previously and is encoded in bits 41–59 of the output bit stream and stored in the output bit buffer 110. The MELP bandpass voicing parameter is quantized and encoded in block 107. The quantized bandpass voicing parameter is 4 bits representing all four frames and is encoded in the 19–22 bits of the output bit stream and stored in the output buffer 110. Likewise the pitch and gain are quantized and encoded in blocks 108 and 109 respectively. The pitch is quantized to 7 bits and encoded in the 23–29 bits of the output bit stream and stored in the output buffer 110. The gain is quantized to 11 bits and encoded in the 30–40 bits of the output bit stream and stored in the output buffer 110. The MELP parameters for the output block are determined from the combined MELP parameters of the four frames or blocks of speech in a manner described previously. Upon completing the process, the 60-bit serial stream representing 100 ms of a voice message is transmitted at a rate of 600 bps. Thus for every 100 ms, 60 bits of information representing 100 ms is transmitted. A reverse process is undertaken at the receiver.

Figure 2:
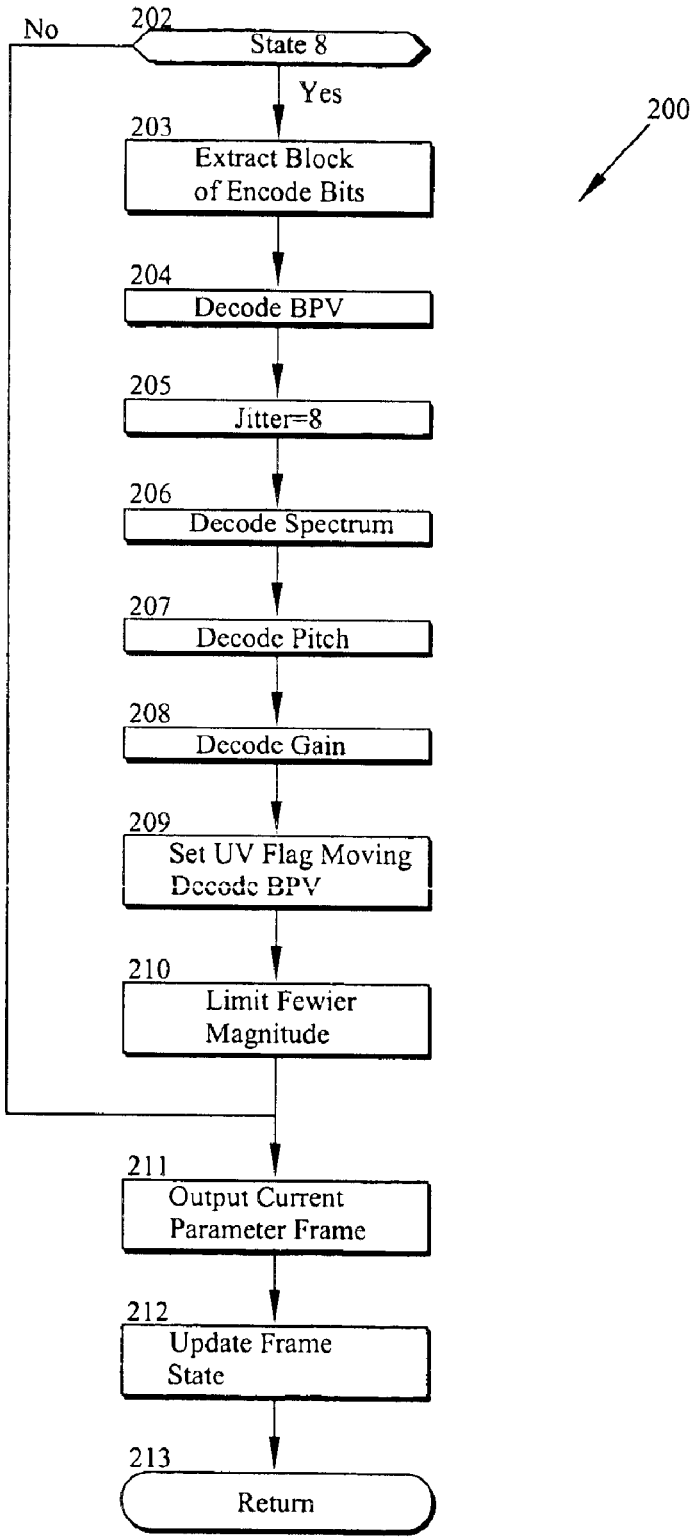
FIG. 2 illustrates a schematic block diagram of a MELP 600 decoding process according to the disclosed subject matter.

An MELP 600 decoder embodiment's block diagram 200 is shown in FIG. 2. The disclosed subject matter reconstructs estimates of each speech frame via the quantized transmitted parameters of the aggregate output block. Upon receipt of the output bit stream. The state is originated at the zero state in block 202. First, the individual codebook indices are recovered from the received bit-stream in block 203. After recovering the indices, each parameter is reconstructed by codebook look-up over the four frame block. The BPV is decoded in block 204, spectrum, pitch, gain, are likewise decoded in blocks 206, 207 and 208 respectively. Jitter is set at a predetermined value in block 205 and a UV flag is established from the BPV in block 209. The Fourier Magnitude is established from the UV flag in block 210. Finally, each MELP parameter is stored into a frame buffer and output block 211 to allow each frame's parameters to be played back (reconstructed) at the appropriate time. After each frame is reconstructed the frame state is updated in block 212 and the next frame is reconstructed from the unquantized MELP parameter stored in the buffer and output block 211. This process is repeated as shown in block 213 until the entire 100 ms voice message is reconstructed. These reconstructed parameters are then used by the MELP 2400 Synthesis process as the current frames actual MELP parameters.

Exemplary algorithms representing embodiments of the processes described in FIGS. 1 and 2 are shown below for illustrative purposes only and is not intended to limit the scope of the described method. The generic algorithms are shown for an encoder and a decoder. An embodiment uses the MELP MIL-STD-3005 parametric model parameters; modified to run with a frame length of 25 ms (standard uses a 22.5 ms frame). The embodied algorithm vector quantizes the 25 ms frame MELP parameters using a block length of four frames, or 100 ms block.

Generic encoder algorithm

ENCODER

Block 101

```
Store MELP Parameters into Block Buffer
bpv_frame[STATE]              =melp_bpv
pitch_frame[STATE]            =melp_pitch
gain_frame[2*STATE+0]         =melp_gainG1
gain_frame[2*STATE+1]         =melp_gainG2
lsf_frame[STATE][0, . . . ,9] =melp_lsf[0, . . . ,9]
wgt_frame[STATE][0, . . . ,9] =melp_wgt[0, . . . ,9]
future_pitch                  =melp_future_pitch
```

Block 102

```
STATE 0
if STATE <> 1 goto step 10
else continue
```

Block 103

```
STATE 1
if STATE <> 1 GOTO STEP 5
else continue
```

-continued

Generic encoder algorithm

ENCODER

Block 104

```
Encode Spectrum for FRAME 0 and 1
sqrtlsfw[0, . . . ,9]          =wgt_frame[0][0, . . . ,9]
sqrtlsfw[10, . . . ,19]        =wgt_frame[1][0, . . . ,9]
lsf[0, . . . ,9]               =lsf_frame[0][0, . . . ,9]
lsf[10, . . . ,19]             =lsf_frame[1][0, . . . ,9]
big                            =MAX (sqrtlsfw[0, . . . ,19])
sqrtlsfw[0, . . . ,9]          =sqrt (sqrtlsfw[0, . . . ,19]/big)
scaled_mean[0, . . . ,19]      =MEAN[0, . . . ,19] * sqrtlsfw[0, . . . ,19]
scaled_lsf[0, . . . ,19]       =lsf[0, . . . ,19] * sqrtlsfw[0, . . . ,19]
CBerror[0][0, . . . ,19]       =scaled_lsf[0, . . . ,19] − scaled_mean[0, . . . ,19]
best[0, . . . ,M_BEST] = MAX_POS_NUM
bestindex1[0, . . . ,M_BEST]=0
CB_RAM[0, . . . ,1023][0, . . . ,19] = LSF_CB1[0, . . . ,1023][0, . . . ,19]* sqrtlsfw[0, . . . ,19]
MIN dist1(CBerror[0, . . . ,M_BEST][0, . . . ,19],CB_RAM[0, . . . ,1023][0, . . . ,19]
{bestindex1[0, . . . ,M_BEST] M_BEST index}
CB1_bestindex1[0, . . . ,M_BEST][0, . . . ,19] = LSF_CB1[bestindex1[0, . . . ,M_BEST][0, . . . ,19]*
sqrtlsfw[0, . . . ,19]
best[0, . . . ,M_BEST] = MAX_POS_NUM
bestindex2[0, . . . ,M_BEST] = 0
CBerror[0, . . . ,M_BEST][0, . . . ,19] = scaled_lsf[0, . . . ,19] − scaled_mean[0, . . . ,19]
                        − CB1_bestindex1[0, . . . ,M_BEST][0, . . . ,19]
CB_RAM[0, . . . ,511][0, . . . ,19] = LSF_CB2[0, . . . ,511][0, . . . ,19]*sqrtlsfw[0, . . . ,19]
MIN dist1(CBerror[0, . . . ,M_BEST][0, . . . ,19], CB_RAM[0, . . . ,511][0, . . . ,19])
{bestindex2[0, . . . ,M_BEST] M_BEST index}
CB1_bestindex1[0, . . . ,M_BEST][0, . . . ,19] = LSF_CB1[bestindex1[0, . . . ,M_BEST]][0, . . . ,19] *
sqrtlsfw[0, . . . ,19]
CB2_bestindex2[0, . . . ,M_BEST][0, . . . ,19] = LSF_CB2[bestindex2[0, . . . ,M_BEST][0, . . . ,19] *
sqrtlsfw[0, . . . ,19]
CBerror[0][0, . . . ,19] = scaled[0, . . . ,19] − scaled_mean[0, . . . ,19]
MIN dist1 (CBerror[0][0, . . . ,19],
CB1_bestindex1[j=0, . . . ,M_BEST][0, . . . ,19]+CB2_bestindex2[k=0, . . . ,M_BEST][0, . . . ,19])
{where j, k result in minimum of the minimums}
spect1_stage 1 = bestindex1[j]
spect1_stage 2 = bestindex2[k]
goto step 10
Where
```

$$\text{dist1}(x, y) = \sum_{i=0}^{N-1} (Xi - Yi)^2$$

Block 105

```
STATE 2
if STATE == 2 goto step 10
else continue
```

Block 106

```
Encode Spectrum for FRAME 2 and 3
sqrtlsfw[0, . . . ,9]          =wgt_frame[2][0, . . . ,9]
sqrtlsfw[10, . . . ,19]        =wgt_frame[3][0, . . . ,9]
lsf[0, . . . ,9]               =lsf_frame[2][0, . . . ,9]
lsf[10, . . . ,19]             =lsf_frame[3][0, . . . ,9]
big                            =MAX (sqrtlsfw[0, . . . ,19])
sqrtlsfw[0, . . . ,19]         =sqrt (sqrtlsfw[0, . . . ,19]/big)
scaled_mean[0, . . . ,19]      =MEAN[0, . . . ,19] * sqrtlsfw[0, . . . ,19]
scaled_lsf[0, . . . ,19]       =lsf[0, . . . ,19] * sqrtlsfw[0, . . . ,19]
CBerror[0][0, . . . ,19]       =scaled_lsf[0, . . . ,19] − scaled_mean[0, . . . ,19]
best[0, . . . ,M_BEST] = MAX_POS_NUM
bestindex1[0, . . . ,M_BEST] = 0
CB_RAM[0, . . . ,1023][0, . . . ,19] = LSF_CB1[0, . . . ,1023][0, . . . ,19]*sqrtw[0, . . . ,19]
MIN dist1(CBerror[0, . . . ,M_BEST][0, . . . ,19],CB_RAM[0, . . . ,1023][0, . . . ,19])
{bestindex1[0, . . . ,M_BEST] M_BEST index}
CB1_bestindex1[0, . . . ,M_BEST][0, . . . ,19] = LSF_CB1[bestindex1[0, . . . ,M_BEST][0, . . . ,19]
*sqrtlsfw[0, . . . ,19]
best[0, . . . ,M_BEST] = MAX_POS_NUM
bestindex2[0, . . . ,M_BEST]=0
CBerror[0, . . . ,M_BEST][0, . . . ,19] = scaled_lsf[0, . . . ,19] − scaled_mean[0, . . . ,19]
                        − CB1_bestindex1[0, . . . ,M_BEST][0, . . . ,19]
CB_RAM[0, . . . ,511][0, . . . ,19] = LSF_CB2[0, . . . ,511][0, . . . ,19] * sqrtlsfw[0, . . . ,19]
MIN dist1(CBerror[0, . . . ,M_BEST][0, . . . ,19],CB_RAM[0, . . . ,511][0, . . . ,19])
{bestindex2[0, . . . ,M_BEST] M_BEST index}
CB1_bestindex1[0, . . . ,M_BEST][0, . . . ,19] = LSF_CB1[bestindex1[0, . . . ,M_BEST][0, . . . ,19] *
```

-continued

Generic encoder algorithm

ENCODER sqrtlsfw[0, . . . ,19]
CB1_bestindex2[0, . . . ,M_BEST][0, . . . ,19] = LSF_CB2[bestindex2[0, . . . ,M_BEST][0, . . . ,19] * sqrtlsfw [0, . . . ,19]
CBerror[0][0, . . . ,19] = scaled[0, . . . ,19] − scaled_mean[0, . . . ,19]
MINdist1(CBerror[0][0, . . . ,19], CB1_bestindex1[j=0, . . . ,M_BEST][0, . . . ,19] + CB2_bestindex2[k=0, . . . ,M_BEST][0, . . . ,19])
{where j, k result in minimum of the minimums}
spect2_stage1 = bestindex1[j]
spect2_stage2 = bestindex2[k]
Block 107

Encode Band Pass Voicing
bpv_frame[0, . . . ,3] = BPV_STAGE1[bpv_frame[0, . . . ,3]]
Min dist1(bpv_frame[0, . . . ,3], BPV_STAGE2[i = 0, . . . ,15][0, . . . ,3]) {bpv_index = i, which minimized dist1}
Block 108

Encode Pitch
p[0] = MEDIAN(old_p, pitch_frame[0], pitch_frame[1])
p[1] = MEDIAN(pitch_frame[0], pitch_frame[1], pitch_frame[2])
p[2] = MEDIAN(pitch_frame[1], pitch_frame[2], pitch_frame[3])
p[3] = MEDIAN(pitch_frame[2], pitch_frame[3], future_pitch)
MIN dist1(p[0, . . . ,3], PITCH_CB[i=0, . . . ,127][0, . . . ,3]{pitch_index = i, which minimized dist1}
old_p = p[3]
Block 109

Encode Gain
Min dist2(gain_frame[0, . . . ,7], GAIN_CB[i=0, . . . ,2047]) {gain_index = i, which minimizes dist2}
where $$\text{dist2}(x, y) = \sum_{i=0}^{N-1} \text{abs}(Xi - Yi)$$

Block 110

Output MELP 600 Bit Stream
bitbuf[0, . . . ,9] =(spect1_stage1 >> (0, . . . ,9) & 1
bitbuf[10, . . . ,18] =(spect1_stage2 >> (0, . . . ,8)) & 1
bitbuf[19, . . . ,22] =(bpv_index >> (0, . . . ,3)) & 1
bitbuf[23, . . . ,29] =(pitch_index >>(0, . . . ,6)) & 1
bitbuf[30, . . . ,40] =(gain_index >>(0, . . . ,10)) & 1
bitbuf[41, . . . ,50] =(spect2_stage1 >>(0, . . . ,9)) & 1
bitbuf[51, . . . ,59] =(spect2_stage2 >> (0, . . . ,8)) & 1
Block 111

Advance State
STATE = (STATE + 1) % 4
Block 112

Return to MELP 2400 processing
return to MELP 2400 analysis

Generic decoder algorithm

DECODER

Block 202

STATE 0
if STATE <> 0 goto step 10
else continue
Block 203

Extract Block of Encoder Bits
spect1_stage1 = 1*bitfuf[ 0] + 2*bitbuf[ 1] + 4*bitbuf[ 2] + . . . + 512*bitbuf[9]
spect1_stage2 = 1*bitbuf[10] + 2*bitbuf[11] + 4*bitbuf[12] + . . . + 256*bitbuf[18]
bpv_index = 1*bitbuf[19] + 2*bitbuf[20] + 4*bitbuf[21] + 8*bitbuf[22]
pitch_index = 1*bitbuf[23] + 2*bitbuf[24] + 4*bitbuf[25] + . . . + 64*bitbuf[29]
gain_index = 1*bitbuf[30] + 2*bitbuf[31] + 4*bitbuf[32] + . . . + 1024*bitbuf[40]

-continued

Generic decoder algorithm

DECODER

```
spect2_stage1   = 1*bitbuf[41] + 2*bitbuf[42] + 4*bitbuf[43] + . . . + 512*bitbuf[50]
spect2_stage2   = 1*bitbuf[51] + 2*bitbuf[52] + 4*bitbuf[53] + . . . + 256*bitbuf[59]
Block 204

Decode Band Pass Voicing
bpv_frame[0, . . . ,3] = BPV_CB[bpv_index][0, . . . ,3]
Block 205

Jitter
jitter_frame[0, . . . ,3] = 0
Block 206

Decode Spectrum
    lsf_frame[0][0, . . . ,9]    = LSF_CB1[spect1_stage1][0, . . . ,9]
                                 + LSF_CB2[spect1_stage2][0, . . . ,9]
                                 +MEAN[0, . . . ,9]
    lst_frame[1][0, . . . ,9]    = LSF_CB1[spect1_stage1][10, . . . ,19]
                                 + LSF_CB2[spect1_stage2][10, . . . ,19]
                                 + MEAN[0, . . . ,9]
    lsf_frame[2][0, . . . ,9]    = LSF_CB1[spect2_stage1][0, . . . ,9]
                                 + LSF_CB2[spect2_stage2][0, . . . ,9]
                                 + MEAN[0, . . . ,9]
    lsf_frame[3][0, . . . ,9]    = LSF_CB1[spect2_stage1][10, . . . ,19]
                                 + LSF_CB2[spect2_stage2][10, . . . ,19]
                                 + MEAN[0, . . . ,9]
Block 207

Decode Pitch
pitch_frame[0, . . . ,3] = PITCH_CB[pitch_index][0, . . . ,3]
Block 208

Decode Gain
gainG1_frame[0, . . . ,3] = GAIN_CB[gain_index][0,2, . . . ,6]
gainG2_frame[0, . . . ,3] = GAIN_CB[gain_index][1,3, . . . ,7]
Block 209

UV Flag
if bpv_frame[0] == 0 then uvflag_frame[0] = 1
else uvflag_frame[0] = 0
                                 .
                                 .
                                 .
if bpv_frame[3] == 0 then uvflag_frame[3] = 1
else uvflag_frame[3] = 0
Block 210

Fourier Magnitude
if uvflag_frame[0] == 1 then
   fsmag_frame[0][0, . . . ,9] = FS_MAG_UV[0, . . . ,9]
else
   fsmag_frame[0][0, . . . ,9] = FS_MAG_V[0, . . . ,9]
                                 .
                                 .
                                 .
if uvflag_frame[3] == 1 then
   fsmag_frame[3][0, . . . ,9] = FS_MAG_UV[0, . . . ,9]
else
   fsmag_frame[3][0, . . . ,9] = FS_MAG_V[0, . . . ,9]
Block 211

Output Current Parameter Frame
melp_bpv              =bpv_frame[STATE]
melp_pitch            =pitch_frame[STATE]
melp_gainG1           =gainG1_frame[STATE]
melp_gainG2           =gainG2_frame[STATE]
melp_jitter           =jitter_frame[STATE]
melp_uvflag           =uvflag_frame[STATE]
melp_fsmag[0, . . . ,9] =fsmag_frame[STATE][0, . . . ,9]
melp_lsf[0, . . . ,9]   =lsf_frame[STATE][0, . . . ,9]
Block 212

Update Frame State
STATE = (STATE + 1) MOD 4
```

-continued

| Generic decoder algorithm |
| --- |
| DECODER |
| Block 213 |
| Return MELP 2400 processing<br>return to MELP 2400 synthesis |

Figure 3:
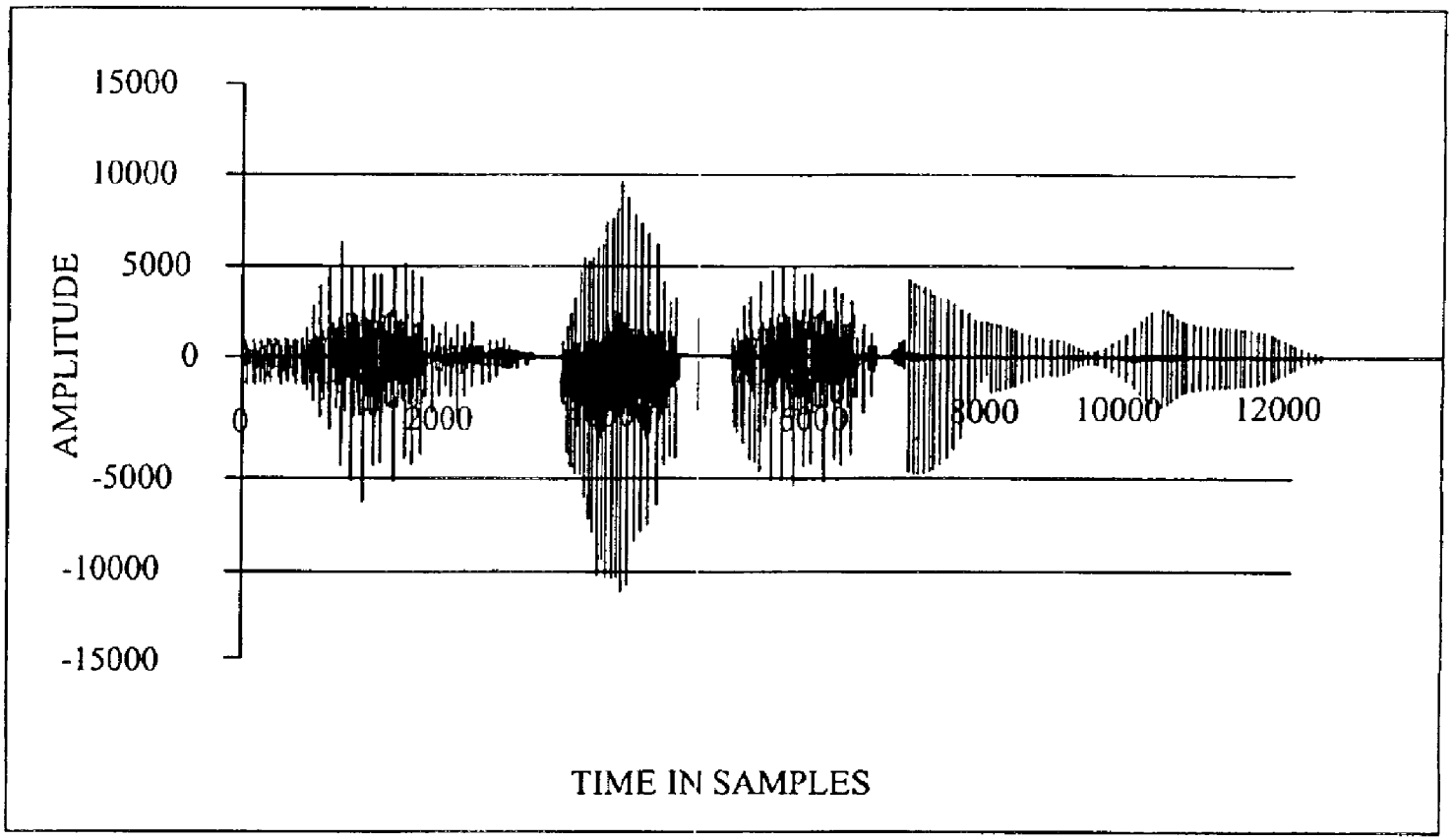
FIG. 3 illustrates human speech in which speech is quantized using Mixed Excitation Linear prediction at 2400 bps.
Figure 4:
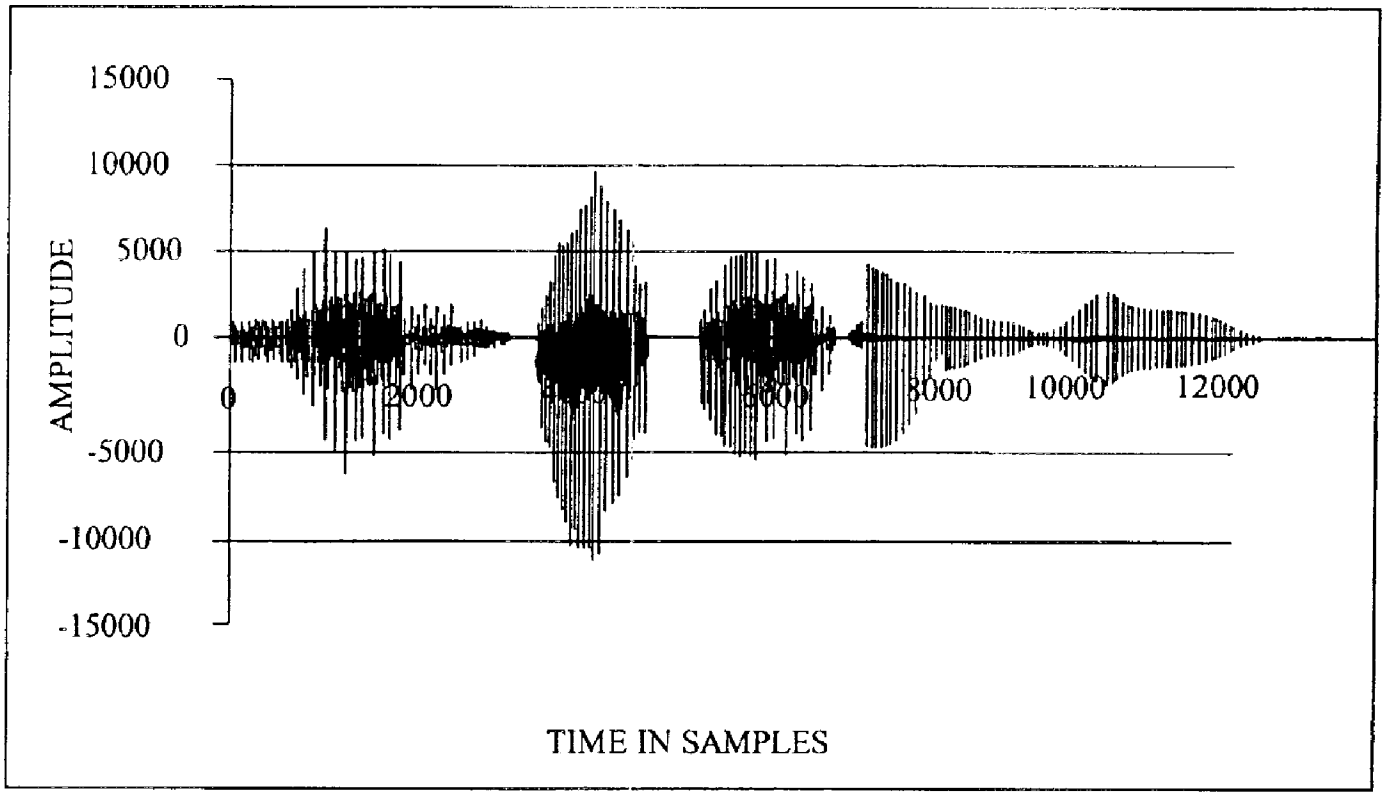
FIG. 4 illustrates the vector quantized speech at 600 bps as seen in FIG. 3 and as described in the disclosed subject matter.

FIG. 3 shows speech that has been quantized using the MELP 2400 speech model. The time domain speech segment contains the phrase "Tom's birthday is in June". FIG. 4 shows the resulting speech segment when quantized using the disclosed subject matter. The quantized speech of FIG. 4 has been reduced to a bit-rate of 600 bps. Comparing the two figures shows only a small amount of variation in the amplitude, in which the signal envelope tracks the higher rate quantization very well. Also, the pitches of the segments are very similar. The unvoiced portion of the speech segment is also very similar in appearance.

While preferred embodiments of the present invention have been described, it is to be understood that the embodiments described are illustrative only and that the scope of the invention is to be defined solely by the appended claims when accorded a full range of equivalence, many variations and modifications naturally occurring to those of skill in the art from a perusal thereof.

What is claimed is:

1. In a voice communication system operating on a bandwidth constrained channel a method of transmitting and receiving a voice signal comprising the steps of:

obtaining a plurality of sub blocks of speech representing the voice signal;

generating unquantized MELP parameters for each of the sub blocks of speech;

quantizing the plurality of sub blocks of speech as an output block using the unquantized MELP parameters of each of the blocks to create quantized MELP parameters of the output block;

encoding the quantized output block into a serial bit stream;

transmitting the serial bit stream over the bandwidth constrained channel;

receiving the serial bit stream;

extracting the quantized MELP parameters of the output block;

decoding the quantized MELP parameters to form unquantized MELP parameters associated with output block of speech;

creating unquantized MELP parameters for each of the sub blocks from the unquantized MELP parameters associated with the output block of speech; and reconstructing the voice signal sequentially for each sub block from their associated unquantized MELP parameters.

2. The method of claim 1, wherein the unquantized MELP parameters are selected from the group of bandpass voicing, energy, pitch, and spectrum.

3. The method of claim 1, wherein the serial bit stream comprises 60 bits transmitted at 600 bps and the output block represents 100 ms of speech.

4. The method of claim 3, further comprising the step of assigning the quantized MELP parameters of bandpass voicing, energy, pitch, first sub block pair spectrum and a second sub block pair spectrum to 4, 11, 7, 19 and 19 bits of the bit stream respectively.

5. The method of claim 1, wherein the quantized MELP parameters are selected from the group of bandpass voicing, energy, pitch and spectrum.

6. In a voice communication system operating on a bandwidth constrained channel a method of transmitting a voice signal comprising the steps of:

obtaining a plurality of blocks of speech representing the voice signal;

generating unquantized MELP parameters for each of the blocks of speech;

quantizing the plurality of blocks of speech as an output block using the unquantized MELP parameters of each of the blocks to create quantized MELP parameters of the output block;

encoding the quantized output block into a serial bit stream; and, transmitting the serial bit stream over the bandwidth constrained channel.

7. The method of claim 6, wherein the unquantized MELP parameters are selected from the group of bandpass voicing, energy, pitch, and spectrum.

8. The method of claim 6, wherein the serial bit stream comprises 60 bits transmitted at 600 bps and the output block represents 100 ms of speech.

9. The method of claim 8, further comprising the step of assigning the quantized MELP parameters of bandpass voicing, energy, pitch, first sub block pair spectrum and a second sub block pair spectrum to 4, 11, 7, 19 and 19 bits of the bit stream respectively.

10. The method of claim 6, wherein the quantized MELP parameters are selected from the group of bandpass voicing, energy, pitch and spectrum.

11. In a voice communication system operating on a bandwidth constrained channel a method of receiving a voice signal comprising the steps of:

receiving a serial bit stream representing the quantized MELP parameters of an output block of speech representing the voice signal; wherein the output block of speech comprises plural successive sub blocks;

extracting quantized MELP parameters;

decoding the quantized MELP parameters to form unquantized MELP parameters associated with output block of speech;

creating unquantized MELP parameters for each of the plural sub blocks from the unquantized MELP parameters associated with the output block of speech; and, reconstructing the voice signal sequentially for each sub block from the associated unquantized MELP parameters.

12. The method of claim 11, wherein the unquantized MELP parameters are selected from the group of bandpass voicing, energy, pitch, and spectrum.

13. The method of claim 11, wherein the serial bit stream comprises 60 bits received at 600 bps and the output block represents 100 ms of speech.

14. The method of claim 13, further comprising the step of extracting the quantized MELP parameters of bandpass voicing, energy, pitch, first sub block pair spectrum and a second sub block pair spectrum from 4, 11, 7, 19 and 19 bits of the bit stream respectively.

15. The method of claim 11, wherein the quantized MELP parameters are selected from the group of bandpass voicing, energy, pitch and spectrum.

16. In a voice communication system, a method of transcoding four MELP 2400 bps 25 ms frames into a MELP 600 bps 100 ms frame for voice communication over a bandwidth limited channel comprising the steps of:

obtaining unquantized MELP parameters from each of the MELP 2400 bps frames;

combining the MELP 2400 bps frames to form one MELP 600 bps 100 ms frame;

creating unquantized MELP parameters for the MELP 600 bps 100 ms frame from unquantized MELP parameter from the MELP 2400 bps frames; and, quantizing the MELP parameters of the MELP 600 bps 100 ms frame and encoding them into a 60 bit serial stream.

17. In a voice communication system, a method of formatting quantized vectors for transmission and reception of 100 ms of speech, comprising the steps of:

quantizing a first half spectrum from a set of unquantized MELP parameter associated with a first set of plural frames of speech;

encoding the first half spectrum in 19 bits of a 60 bit serial stream;

quantizing a second half spectrum from another set of unquantized MELP parameters associated with a second set of plural blocks of speech;

encoding the second half spectrum in 19 bits of the 60 bit serial stream;

quantizing a bandpass voicing parameter created from the unquantized MELP parameters of the first and second set of plural blocks of speech;

encoding the quantized bandpass voicing parameter in 4 bits the 60 bit serial stream;

quantizing a pitch voicing parameter created from the unquantized MELP parameters of the first and second set of plural blocks of speech;

encoding the quantized pitch parameters in 7 bits of the 60 bit serial stream;

quantizing a gain parameter created from the unquantized MELP parameters of the first and second set of plural blocks of speech; and, encoding the quantized gain parameters in 11 bits of the 60 bit serial stream.

18. In a bandwidth constrained channel, a method of transmitting voice data by vector quantization of MELP parameters, the improvement of quantizing MELP parameters for a block of voice date from the unquantized MELP parameters of a plurality of successive frames within the block.

* * * * *